US006515438B2

(12) United States Patent
Choi

(10) Patent No.: US 6,515,438 B2
(45) Date of Patent: Feb. 4, 2003

(54) ELECTRON GUN IN COLOR CRT

(75) Inventor: Jin Yeol Choi, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/971,933

(22) Filed: Oct. 9, 2001

(65) Prior Publication Data

US 2002/0043936 A1 Apr. 18, 2002

(30) Foreign Application Priority Data

Oct. 10, 2000 (KR) ..... 00-59475

(51) Int. Cl.[7] ..... H01J 29/80
(52) U.S. Cl. ..... 315/368.15; 313/414
(58) Field of Search ..... 315/368.11, 368.15, 315/368.24, 379; 313/426–428, 414, 460, 412

(56) References Cited

U.S. PATENT DOCUMENTS

| | | | | |
|---|---|---|---|---|
| 4,599,534 A | | 7/1986 | Shirai et al. | 313/414 |
| 5,146,133 A | | 9/1992 | Shirai et al. | 313/414 |
| 6,342,758 B1 | * | 1/2002 | Nakamura et al. | 313/414 |
| 6,373,178 B1 | * | 4/2002 | Cho et al. | 313/414 |

* cited by examiner

*Primary Examiner*—Don Wong
*Assistant Examiner*—Wilson Lee
(74) *Attorney, Agent, or Firm*—Fleshner & Kim, LLP

(57) ABSTRACT

Electron gun in a color CRT including a controlling electrode and an accelerating electrode each having a distance $S_0$ between a central electron beam pass through hole and an outer electron beam pass through hole for passing electron beams emitted from cathodes, a pre-focusing electrode having a distance $S_1$ between a central electron beam pass through hole and an outer electron beam pass through hole, a focusing electrode and an anode each having a rim at an opposite part for forming single electron beam pass through hole and an electrostatic field controlling body inside of the rim, for forming a large sized main focusing electrostatic lens by a potential difference, and diverging means for diverging the outer electron beams incident on the focusing electrode from the pre-focusing electrode outwardly with respect to the central electron beam, wherein a ratio WS/H of a sum WS of a horizontal diameter of the central electron beam pass through hole of the electrostatic field controlling body and a minimum width 't' of the bridge 'B' surrounding horizontal direction outsides of the central electron beam pass through hole to a horizontal width 'H' of the rim is set to be $0.31 \leqq WS/H \leqq 0.34$ for shifting positions of the outer main focusing electrostatic lenses outward in correspondence to the divergence of the outer electron beams with respect to the central main focusing electrostatic lens, thereby improving a resolution of a picture without an overall change of the electron gun.

5 Claims, 10 Drawing Sheets

ELECTRON GUN IN COLOR CRT

BACKGROUND OF THE INVENTION

1. Field of the Invention

The present invention relates to an electron gun in a color CRT (Cathode Ray Tube), in which a distance between a central electron beam and an outer electron beam is made greater on a deflection center plane for improving a resolution.

2. Background of the Related Art

FIG. 1 illustrates a horizontal longitudinal section of a related art cathode ray tube.

Referring to FIG. 1, the related art cathode ray tube is provided with a panel 1 and a funnel 2 of a front part and a rear part of the cathode ray tube, a neck part 2*a* at an end of the funnel 2, an electron gun 3 in the neck part 2*a* for emitting R, G, B electron beams 3*a,* a deflection yoke 4 on an outer circumference of the funnel 2 for deflection of the electron beams in an upper, lower, left, of right direction, a color purity magnet 5 in front of the deflection yoke 4 for fining tuning a path of the electron beams 3*a,* a shadow mask 6 fitted between the electron gun 3 and the panel 1 for selective pass of the deflected electron beams 3*a,* and a fluorescent surface 7 of R, G, B fluorescent materials on an inside surface of the panel 1.

FIG. 2 illustrates a partial longitudinal section of an electron gun built in a neck part of a color CRT in FIG. 1.

Referring to FIG. 2, the electron gun 3 is provided with cathodes 8, a control electrode 9, an acceleration electrode 10, first and second pre-focusing electrodes 11*a* and 11*b,* a focusing electrode 12 and an anode 13, in an order thereof, so that a preset voltage is applied to each of the electrodes.

Upon putting the cathode ray tube into operation, electron beams 3*a* are emitted from the cathodes 8, controlled, accelerated, and pre-focused by the control electrode 9, the acceleration electrode 10, and the first and second pre-focusing electrodes 11 (11*a* and 11*b*), and subjected to main focusing by a main focusing electro-static lens formed between the focusing electrode 12 and the anode 13 of a potential difference. Then, the electron beams 3*a* are deflected in an upper, lower, left, or right direction by the deflection yoke 4, pass through a shadow mask 6 selectively, and land on a fluorescent surface, to form a picture on the panel 1. A color purity of the picture formed thus may be adjusted more precisely as worker adjusts the color purity magnet 5 to change a path of the electron beams.

In the meantime, it is known that a picture quality becomes the better as a spot size of the landed electron beams 3*a* is made the smaller. The spot size of the electron beams 3*a* is proportional to a diameter of the main focusing electrostatic lens, and the size of the main focusing electrostatic lens is proportional to sizes of electron beam pass through holes 12*a* and 13*a* formed in parts opposite to the focusing electrode 12 and the anode 13.

FIG. 3 illustrates a perspective view of the focusing electrode and the anode of the electron gun in FIG. 2.

Referring to FIG. 3, in order to form a large diametered main focusing electrostatic lens, there are horizontally elongated track type rims 12*b* and 13*b* each forming single electron pass through hole 12*a* or 13*a* for passing the three electron beams 3*a* in parts opposite to the focusing electrode 12 and the anode 13 respectively, and electrostatic field controlling bodies 14 and 15 each provided at a point moved a distance back from the rim 12*b* or 13*b,* respectively.

The horizontally elongated track type rim 12*b* or 13*b* has a small height and a great width, permitting an electric field to penetrate shallow in a vertical direction and deep in a horizontal direction, forming a large equipotential surface curvature in the vertical direction, and a small equipotential surface curvature in the horizontal direction. According to this, a single horizontally elongated main focusing electrostatic lens focuses the electron beams 3*a* strongly in the vertical direction, and weakly in the horizontal direction.

However, the electrostatic field controlling bodies 14 and 15 suppress a horizontal field penetration, resulting to form the curvature of horizontal equipotential surface larger. Consequently, a horizontal focusing power of the main focusing electrostatic lens becomes stronger, making the horizontal and vertical focusing powers of the main focusing electrostatic lens the same.

FIGS. 4A–4D illustrate various examples of electrostatic field controlling bodies fitted to the focusing electrode and the accelerating electrode in FIG. 3. FIG. 4A illustrates a front view of an LB (large aperture with blade) type electrostatic field controlling body disclosed in U.S. Pat. No. 5,512,797 by the inventor. The LB type electrostatic field controlling body 14 or 15 is provided with a rectangular electron beam pass through hole 14G or 15G at a center, and vertical blades 14*a* and 15*a* at both sides thereof. The blades 14*a* and 15*a* make a section modulus greater, to reinforce the electrostatic field controlling bodies 14 and 15 against deformation. However, the blades 14*a* and 15*a* interfere horizontal penetration of an electric field, resulting to form a greater horizontal curvature of the main focusing electrostatic lens, that focuses the electron beams 3*a* excessively in the horizontal direction.

FIG. 4B illustrates a front view of an EA (elliptical aperture) type electrostatic field controlling body developed by Hitachi. The EA type electrostatic field controlling body 14 or 15 is a plate having a vertically elongated elliptical central electron beam pass through hole 14G or 15G, and vertically elongated semi-elliptical outer electron beam pass through holes 14R and 14B, or 15R and 15B. Since the electrostatic field controlling body is not provided with the blades 14*a* and 15*a* as shown in FIG. 4A, the horizontal penetration of the electric field in not interfered, to reduce the horizontal curvature of the main focusing electrostatic lens, that permits to form a large sized main focusing electrostatic lens having vertical and horizontal direction harmonized. However, since the electrostatic field controlling body is not provided with the blades 14*a* and 15*a,* the electrostatic field controlling body has a smaller section modulus, and is liable to deform.

FIG. 4C illustrates a front view of an AEA (Advanced Elliptical Aperture) type electrostatic controlling body disclosed in U.S. Pat. No. 5,146,133 by Hitachi. The AEA type electrostatic controlling body 14 is a plate having three, in line, vertically elongated elliptical electron beam pass through holes 14R, 14G, and 14B, fitted inside of the focusing electrode 12. It is known that the AEA type electrostatic controlling body 14 prevents unbalance between the outer electron beams R, and B and the central electron beam G when the electrostatic controlling body 14 is placed away from the rim 12*b,* i.e., near to the second pre-focusing electrode for making a size of the main focusing electrostatic lens greater.

FIG. 4D illustrates a front view of an XL (Extended Large Aperture) type electrostatic controlling body developed by RCA. The XL type electrostatic controlling body 14 or 15 is a plate having the circular three in-line electron beam pass through holes 14R, 14G, and 14B, or 15R, 15G, and 15B. It is known that it is difficult to form spot sizes of the central electron beam G and the outer electron beam R, or B are the same.

In the meantime, FIG. 5 illustrates an exemplary process in which the electron beams are deflected at the deflection center plane, pass through a shadow mask, and land on the fluorescent surface, schematically. In this instance, the shorter the distance 'Q' between the fluorescent surface 7 and the shadow mask 6, the less the mis-landing of the electron beams 3*a* (R, G, and B) on the fluorescent surface 7 caused by deformation of the shadow mask 6 coming from thermal expansion or vibration. Therefore, in fabrication of the CRT, the distance 'Q' between the fluorescent surface 7 and the shadow mask 6 is set to be minimum. The 'Q' can be made minimum by varying variables on the right side of an equation shown below.

$$Q=Ph\times L/3S_2$$

1. A distance 'L' between the shadow mask 6 and the deflection center plane 4*a*.
2. A horizontal distance Ph between centers of the electron beam pass through holes 6*a*.
3. A distance $S_2$ between center axes of the R, G, and B electron beams 3*a* at the deflection center plane.

The 'L' is set to be minimum, and the 'Ph' is set to be minimum as far as productivity is the greatest. At the end, what is left in above equation for minimizing 'Q' is $S_2$.

As shown in FIGS. 6A and 7, $S_2$ varies with the following variables.

1. A distance $S_0$ between centers of the central electron beam 'G' and the center of the outer electron beam 'R', or 'B' from the cathodes to the acceleration electrode 10.
2. A distance $S_1$ between centers of the central electron beam pass through hole 11G and the outer electron beam pass through hole 11R, or 11B of the first pre-focusing electrode 11*a*.
3. A distance 'P' between centers of the central main focusing electrostatic lens and the outer main focusing electrostatic lens.

The $S_0$ is the same with a distance between centers of the central cathode 8G and an outer cathode 8R, or 8B, centers of the central electron beam pass through hole and an outer electron beam pass through hole of the controlling electrode 9, or centers of the central electron beam pass through hole 10G and an outer electron beam pass through hole 10R, or 10B of the accelerating electrode 10.

The '$S_1$' is set such that an eccentricity '$S_1/S_0$' of the '$S_1$' to the related art '$S_0$' is to be equal to, or greater than unity '$1 \leqq S_1/S_0$', for converging the outer electron beams R, and B toward the central electron beam G. The outer electron beams R, and B are converged toward the central electron beam G according to the following process. In general, the first pre-focusing electrode 11*a* has a voltage higher than the accelerating electrode 10 applied thereto, and the electron beams 3*a* moves from a low voltage to a high voltage. Therefore, as shown in FIG. 6A, when $S_1$ is greater than $S_0$, since the outer electron beams R and B passed through the outer electron beam pass through holes 10R, and 10B of the accelerating electrode 10 respectively go closer to the bridges 'B' surrounding outer sides of the central electron beam R, and B pass through holes respectively, the outer electron beams R and B are converged toward the central electron beam G.

In the foregoing electron gun, if it is intended to make the $S_2$ greater, i.e., the 'Q' smaller, for improving a picture quality of the CRT, it is required to change $S_0$, $S_1$, and P significantly on the whole, accompanying entire change of the electron gun, that imposes a limitation in improvement of the picture quality, as an inside diameter of the neck part the electron gun is fitted therein is limited.

SUMMARY OF THE INVENTION

Accordingly, the present invention is directed to an electron gun in a color CRT that substantially obviates one or more of the problems due to limitations and disadvantages of the related art.

An object of the present invention is to provide an electron gun in a color CRT, in which a distance S2 between a central electron beam G and an outer electron beam R, and B is made greater at a deflection center plane for improving a resolution of a picture.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electron gun in a color CRT includes a controlling electrode and an accelerating electrode each having a distance $S_0$ between a central electron beam pass through hole and an outer electron beam pass through hole for passing electron beams emitted from cathodes, a pre-focusing electrode having a distance $S_1$ between a central electron beam pass through hole and an outer electron beam pass through hole, a focusing electrode and an anode each having a rim at an opposite part for forming single electron beam pass through hole and an electrostatic field controlling body inside of the rim, for forming a large sized main focusing electrostatic lens by a potential difference, and diverging means for diverging the outer electron beams incident on the focusing electrode from the pre-focusing electrode outwardly with respect to the central electron beam, wherein a ratio WS/H of a sum WS of a horizontal diameter of the central electron beam pass through hole of the electrostatic field controlling body and a minimum width 't' of the bridge 'B' surrounding horizontal direction outsides of the central electron beam pass through hole to a horizontal width 'H' of the rim is set to be $0.31 \leqq WS/H \leqq 0.34$ for shifting positions of the outer main focusing electrostatic lenses outward in correspondence to the divergence of the outer electron beams with respect to the central main focusing electrostatic lens.

The diverging means is one $S_1/S_0$ is set to be in a range of $0.96 \leqq S_1/S_0 \leqq 1$.

The diverging means is a color purity magnet fitted to a deflection yoke of the color cathode ray tube.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. The electron gun in a color CRT of the present invention has the same structure with the related art electrostatic field electron gun, except that detailed design dimensions differ. Accordingly, in explanation of the electron gun of the present invention, reference symbols in the related art electron gun will be used without change in the present invention.

The present invention suggests to provide a diverging means for diverging outer electron beams G, and B with respect to a central electron beam before the electron beams reach to the main focusing electrostatic lens, and to shift outer main focusing electrostatic lenses outwardly with respect to the central main focusing electrostatic lens in correspondence to the diverged outer electron beams R, and B, for setting a distance P' between centers of the central electron beam G and the outer electron beam R or B greater than the related art 'p' at the deflection center plane.

Figure 1:
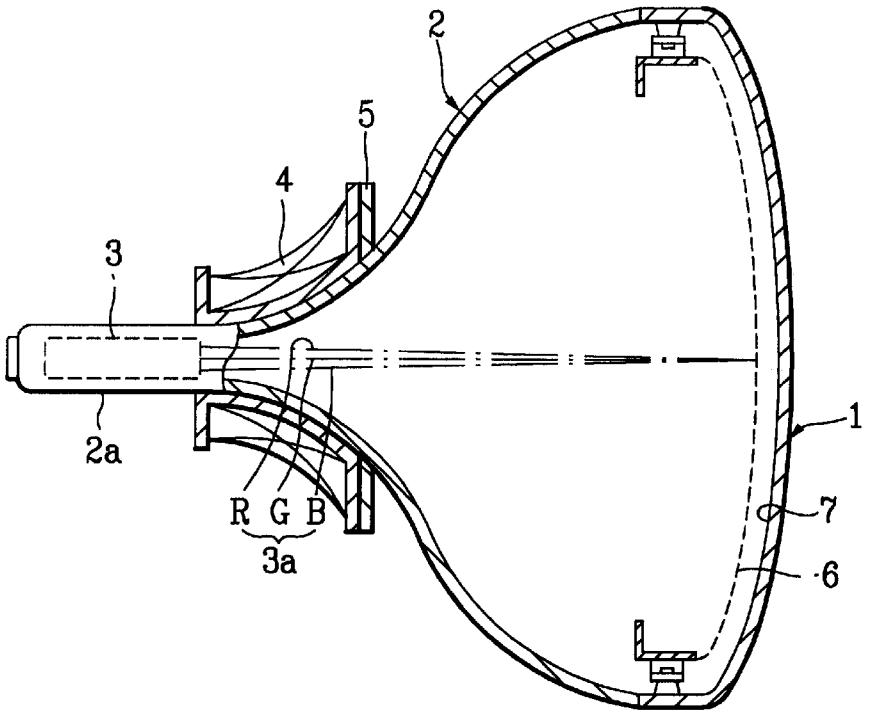
FIG.1 Related Art
FIG. 1 illustrates a horizontal longitudinal section of a related art color cathode ray tube.
Figure 2:
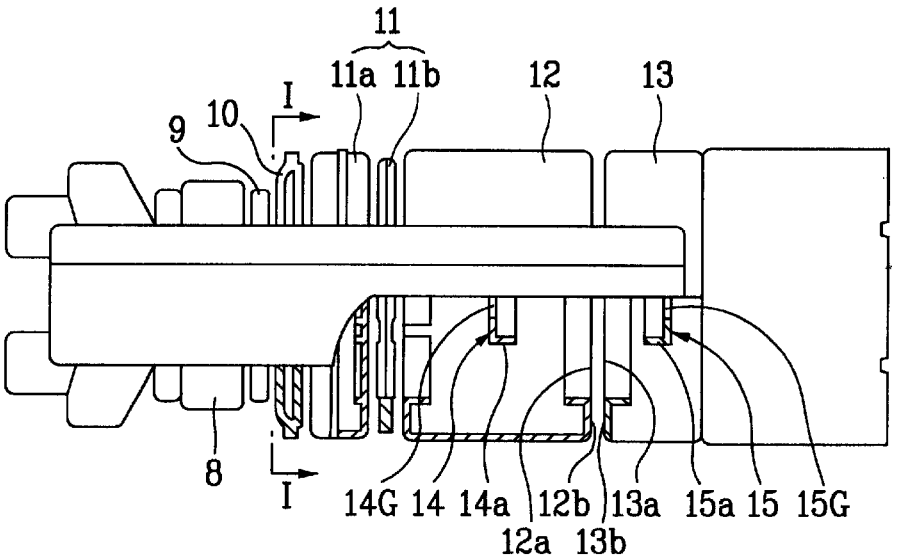
FIG.2 Related Art
FIG. 2 illustrates a partial longitudinal section of an electron gun built in a neck part of a color CRT in FIG. 1.
Figure 3:
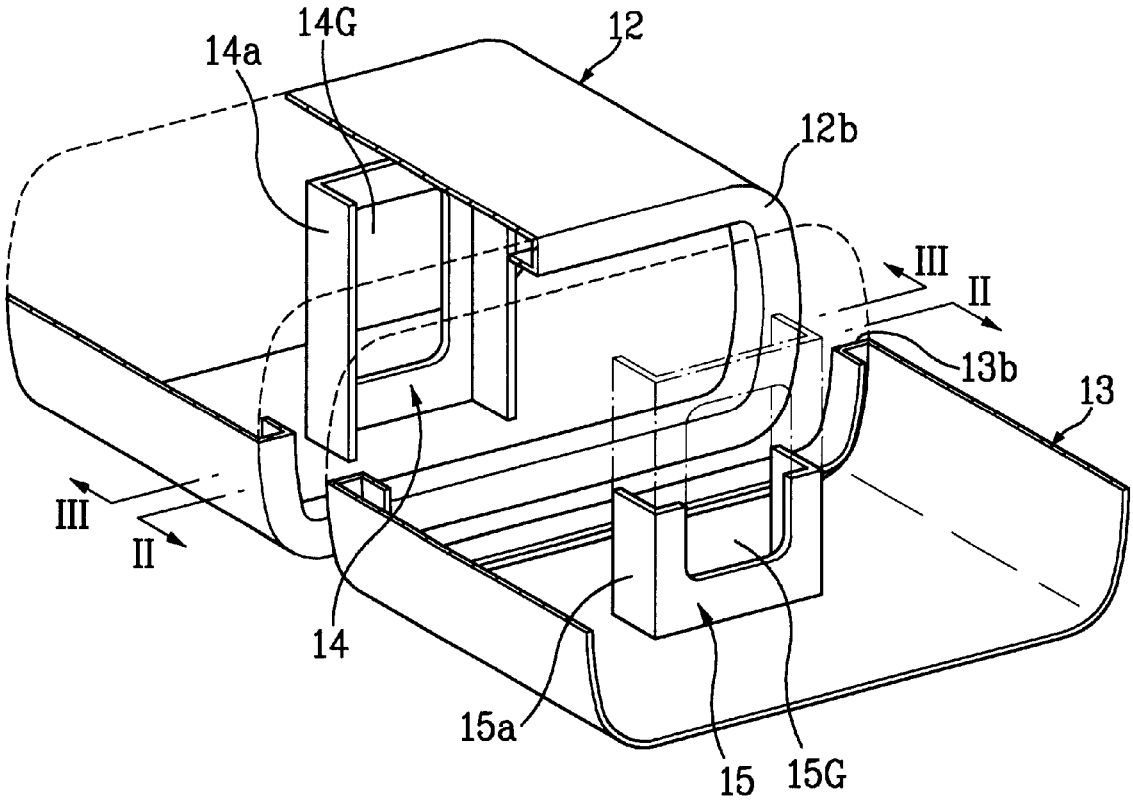
FIG.3 Related Art
FIG. 3 illustrates a perspective view of the focusing electrode and the anode of the electron gun in FIG. 2.
Figure 4A:
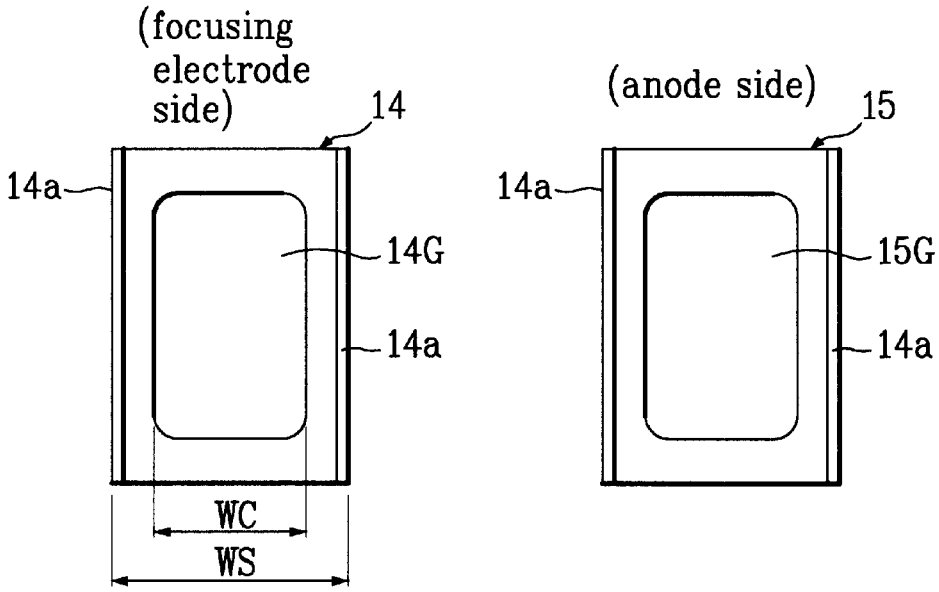
FIG. 4A Related Art
FIGS. 4A–4D illustrate various examples of electrostatic field controlling bodies fitted to the focusing electrode and the accelerating electrode in FIG. 3.
Figure 4B:
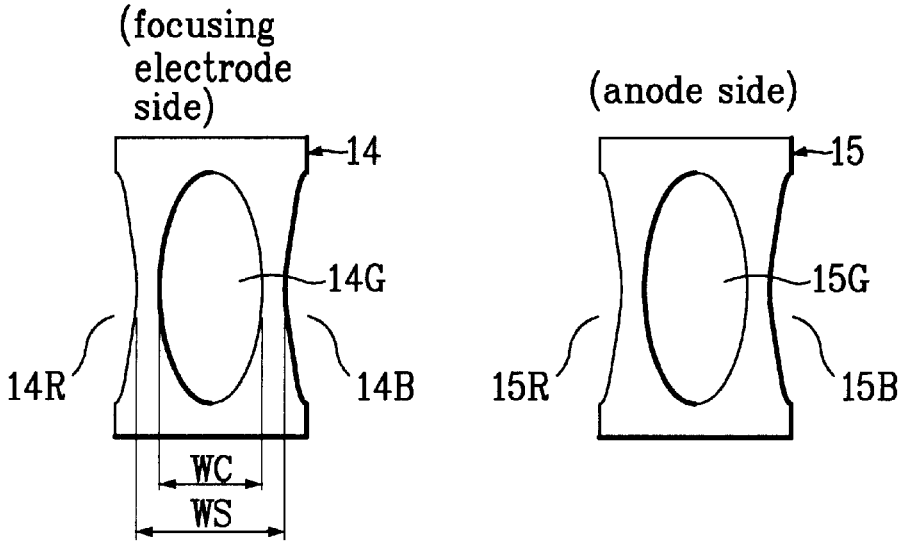
FIG. 4B Related Art
Figure 4C:
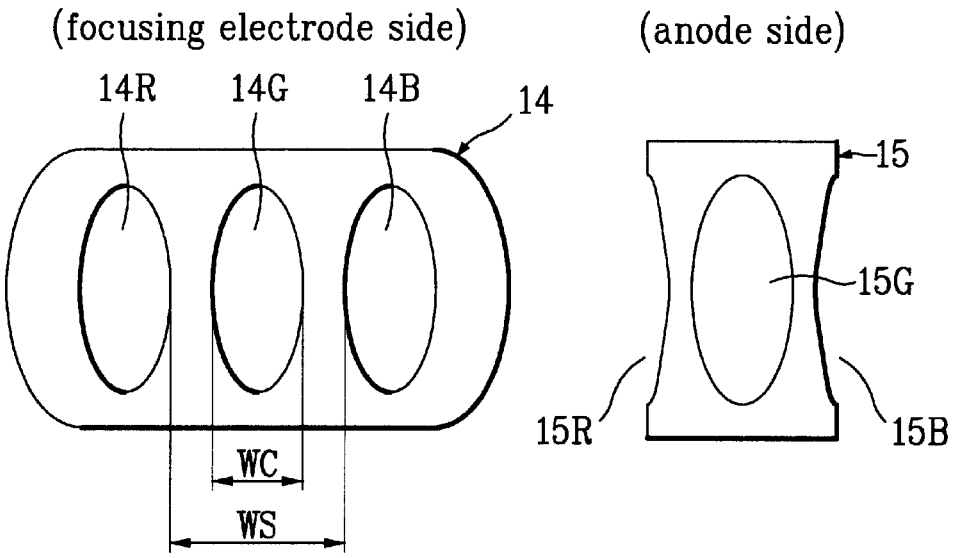
FIG. 4C Related Art
Figure 4D:
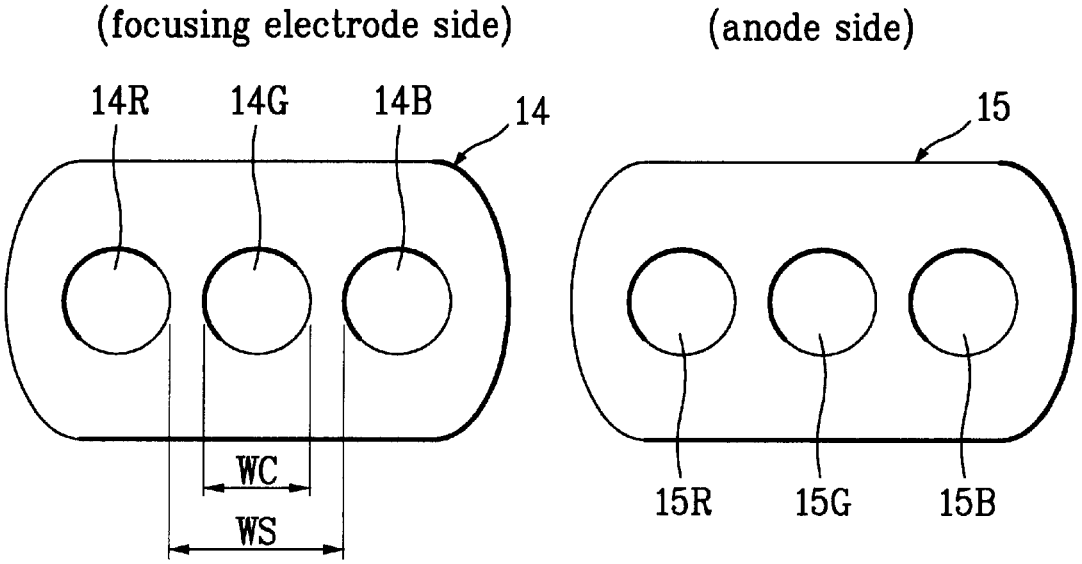
FIG. 4D Related Art
Figure 5:
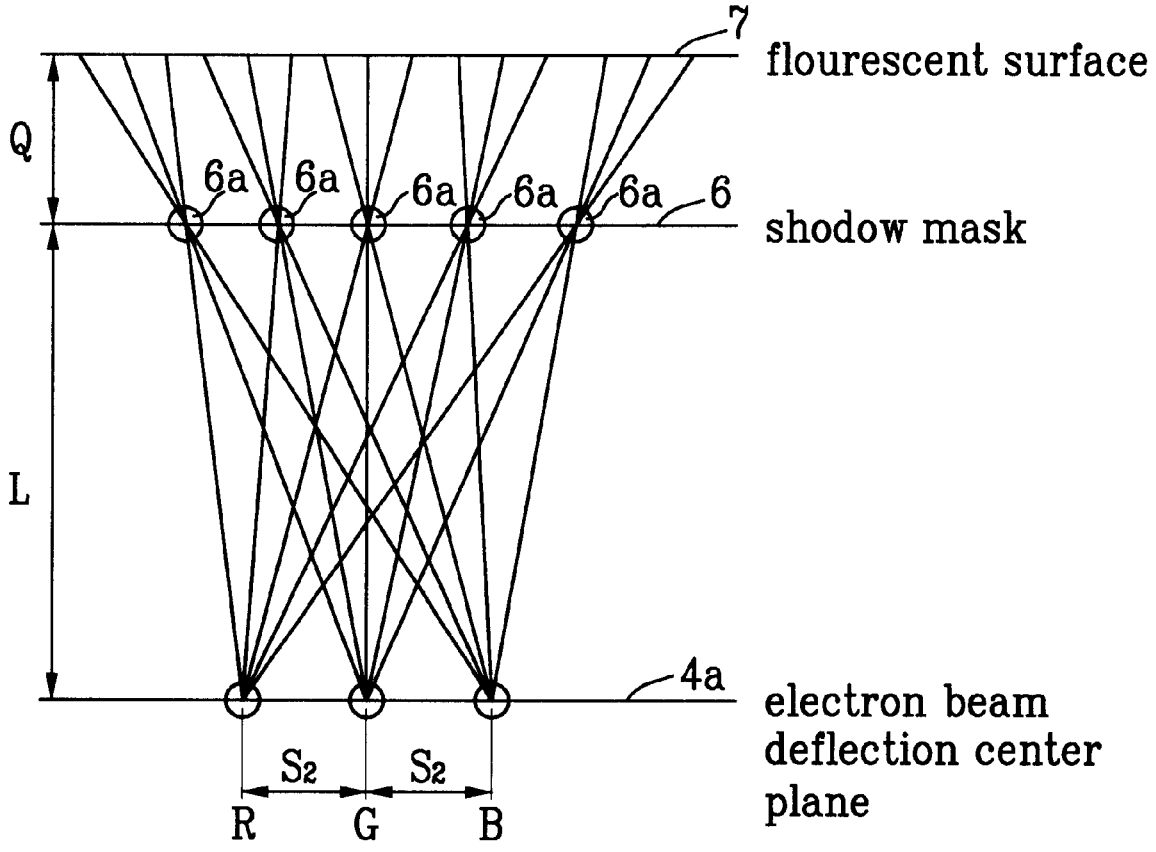
FIG.5 Related Art
FIG. 5 illustrates an exemplary process in which the electron beams are deflected at the deflection center plane, pass through a shadow mask, and land on the fluorescent surface, schematically.
Figure 6A:
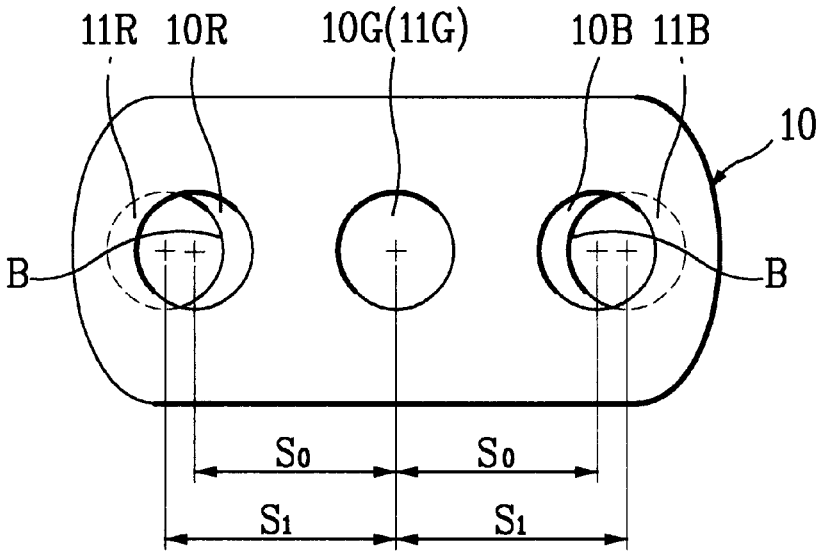
FIG. 6A illustrates a front view of an accelerating electrode seen from an 'I' direction in FIG. 1 for showing outer electron beam pass through holes of a pre-focusing electrode has a less eccentricity than the outer electron beam pass through holes of the accelerating electrode.
Figure 6B:
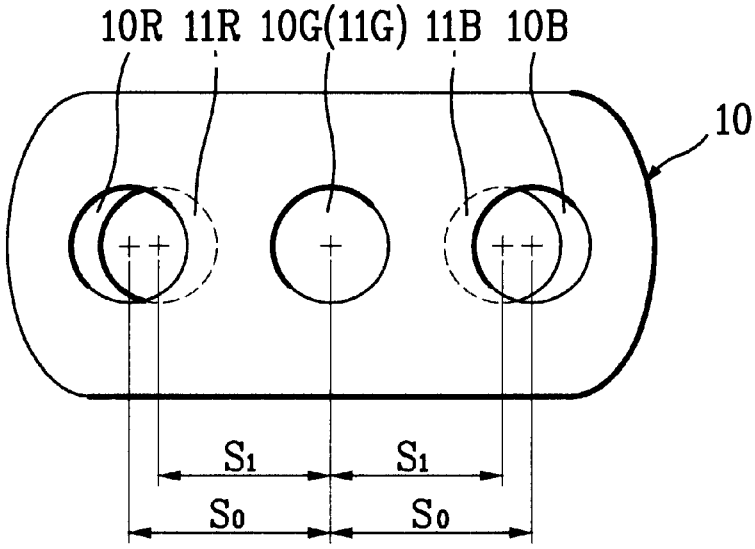
FIG. 6B illustrates a front view of an accelerating electrode seen from an 'I' direction in FIG. 1 for showing outer electron beam pass through holes of a pre-focusing electrode has a greater eccentricity than the outer electron beam pass through holes of the accelerating electrode.
Figure 7:
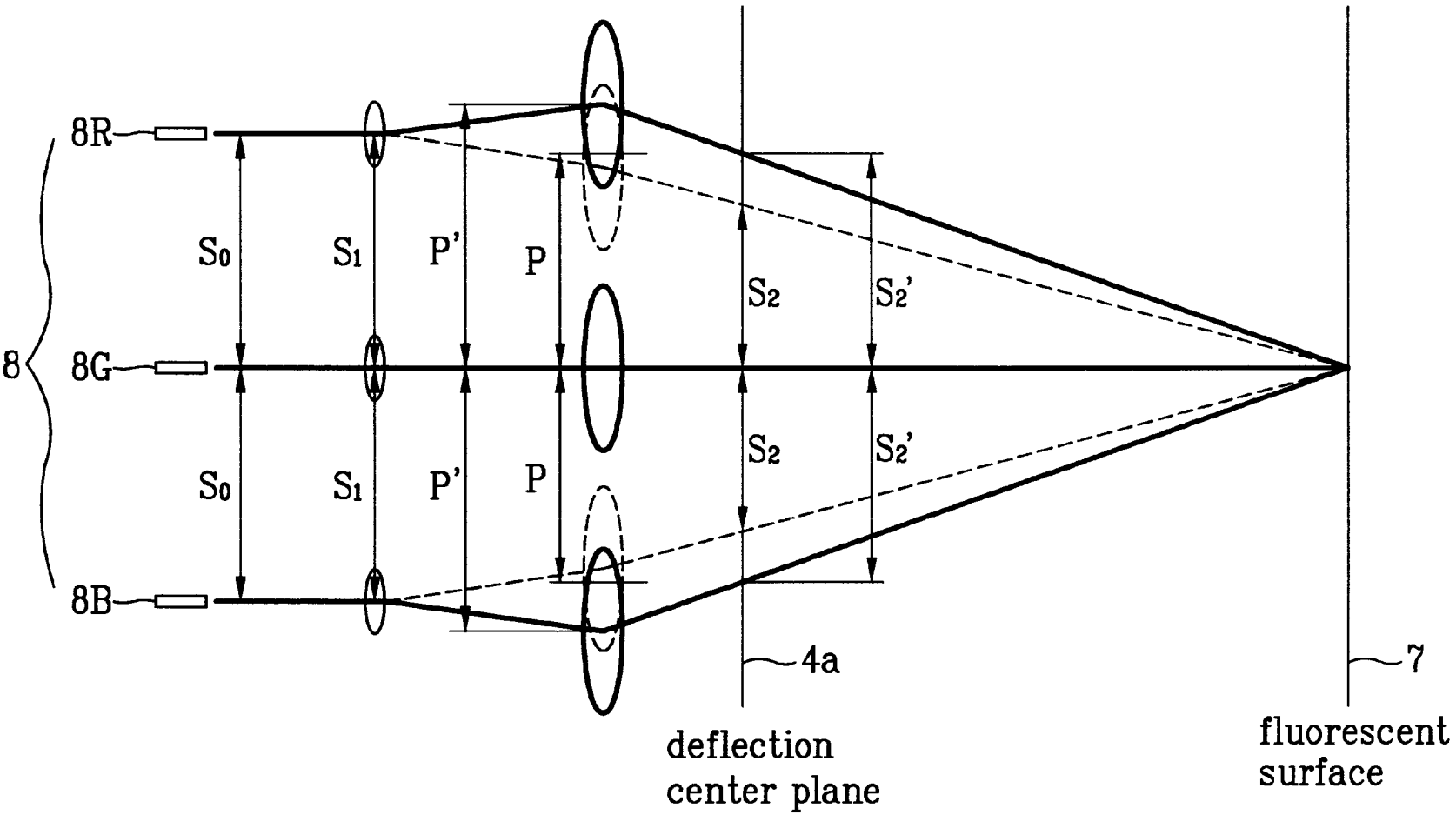
FIG. 7 illustrates an example of electron beam paths from cathodes to a screen.

Referring to FIGS. 6B and 7, the diverging means may be one that sets a distance $S_1$ between the outer electron beam pass through hole 11R or 11B and the central electron beam pass through hole 11G of the pre-focusing electrode 11 smaller than a distance $S_0$ between the outer electron beam pass through hole 10R or 10B and the central electron beam pass through hole 10G of the accelerating electrode 10, i.e., the outer electron beam pass through holes 11R and 11B of the pre-focusing electrode 11 are made less eccentric. In general, there are plural, for an example two, pre-focusing electrodes, such as in the order of first and second pre-focusing electrodes 11*a* and 11*b*, wherein it is preferable that the electron beam pass through holes in the first pre-focusing electrode 11*a* is made eccentric for greater divergence of the outer electron beams R and B even with a small eccentricity.

The divergence of the outer electron beams R and B with respect to the central electron beam G by the foregoing system before the outer electron beams R and B are incident on the main focusing electrostatic lens will be explained.

Referring to FIG. 6B, when $S_1$ is smaller than $S_0$, since the outer electron beams R and B, passed through the outer electron beam pass through holes 10R and 10B of the acceleration electrode 10, are positioned adjacent to the outer bridges B that surround the outer electron beam pass through holes 11R and 11B of the first pre-focusing electrode 11*a* having a voltage higher than the accelerating electrode 10 applied thereto, the electron beams R and B are diverged.

Figure 8:
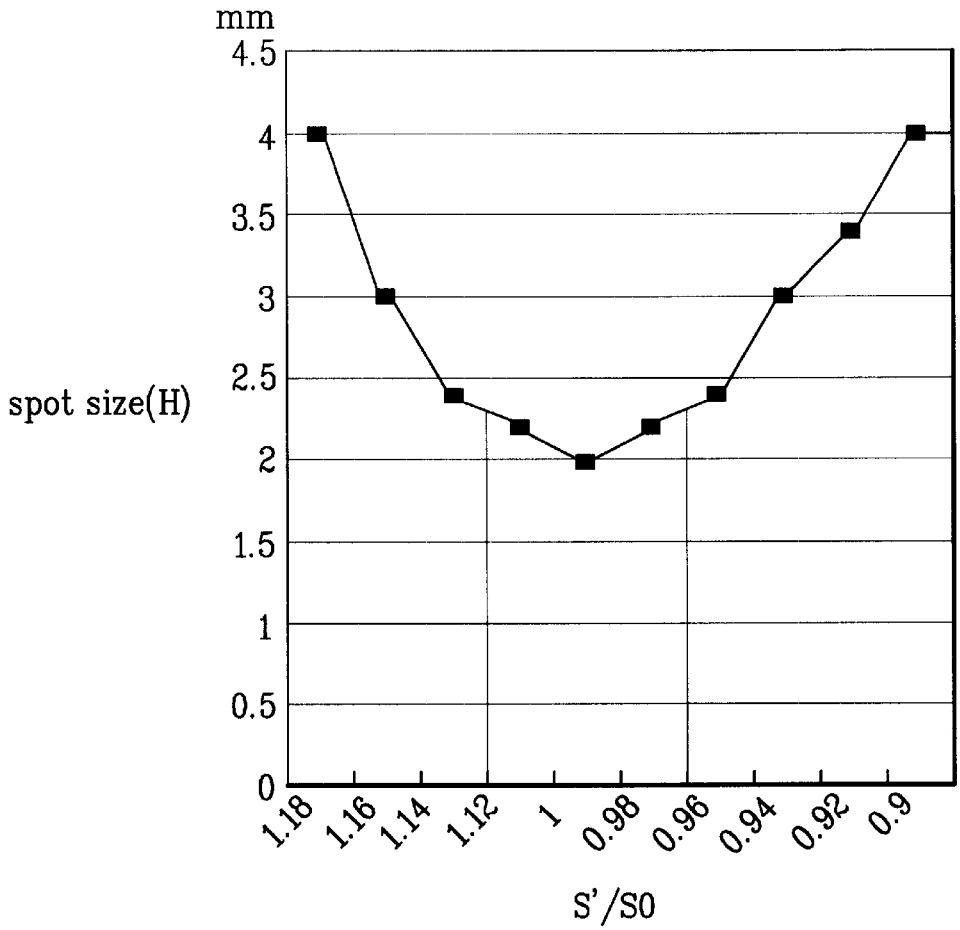
FIG. 8 illustrates a graph of a result of computer simulation showing $S_1/S_0$ vs. a spot size of electron beams landing on a screen in accordance with the present invention.

FIG. 8 illustrates a graph of a result of computer simulation showing $S_1/S_0$ vs. a spot size of electron beams landing on a screen in accordance with the present invention.

Referring to FIG. 8, it can be known that a preferable $S_1/S_0$ is in a range of $0.96 \leqq S_1/S_0 \leqq 1.12$. If $S_1/S_0$ is outside of the range, the spot size of the electron beam 3*a* increases sharply, affecting characteristics of the picture on the CRT. However, as explained before, when $S_1/S_0$ is equal to, or greater than unity, the outer electron beams R and B does not diverge, but converges with respect to the central electron beam G the same as the related art electron gun 3, $S_1/S_0$ is set to be in the range of $0.96 \leqq S_1/S_0 \leqq 1.12$.

Figure 9:
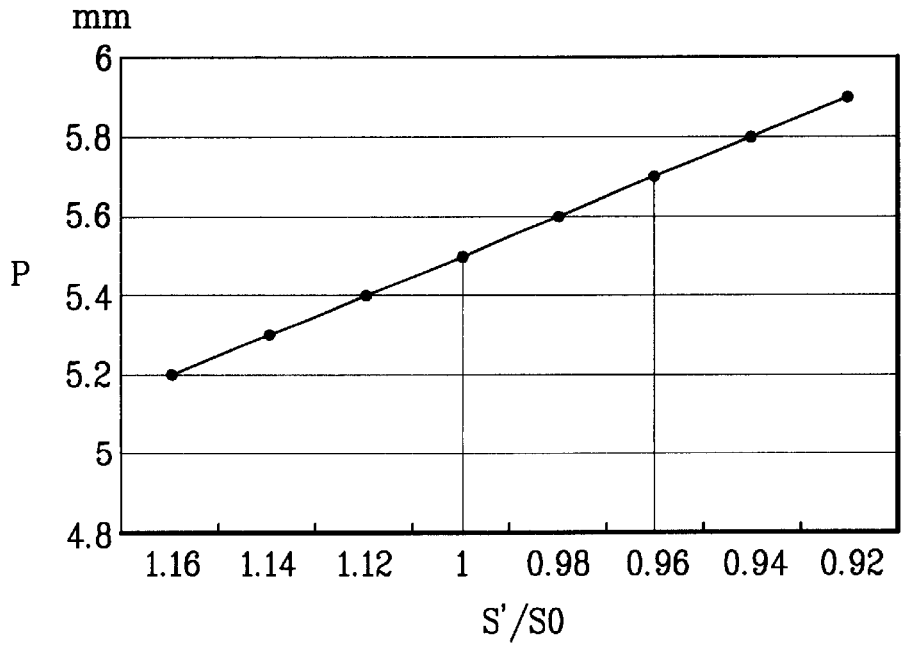
FIG. 9 illustrates a graph of a result of computer simulation showing $S_1/S_0$ vs. a distance 'P' between centers of central main focusing electrostatic lens and an outer main focusing electrostatic lens in accordance with the present invention.

FIG. 9 illustrates a graph of a result of computer simulation showing $S_1/S_0$ vs. a distance 'P' between centers of central main focusing electrostatic lens and an outer main focusing electrostatic lens in accordance with the present invention.

Referring to FIG. 9, since a divergence angle is proportional to $S_1/S_0$, a required 'P' is predictable from the diverging angle. In this instance, it can be known that, when $S_1/S_0$ is in a range of $0.96 \leqq S_1/S_0 \leqq 1.0$, 'P' has a range of 5.5–5.7 mm.

Another embodiment of the diverging means may be a color purity magnet 5 fitted to a front part of the deflection yoke 4. The color purity magnet 5 has a function for adjusting the color purity to a preset value if the color purity of the picture is lower than the preset value after fabrication of the CRT. Since a magnetic field from the color purity magnet 5 mostly reaches to the electron beams 3*a* before the electron beams 3*a* are incident on the main focusing electrostatic lens, the diverging angle can be made greater by adjusting the color purity magnet 5.

Figure 10A:
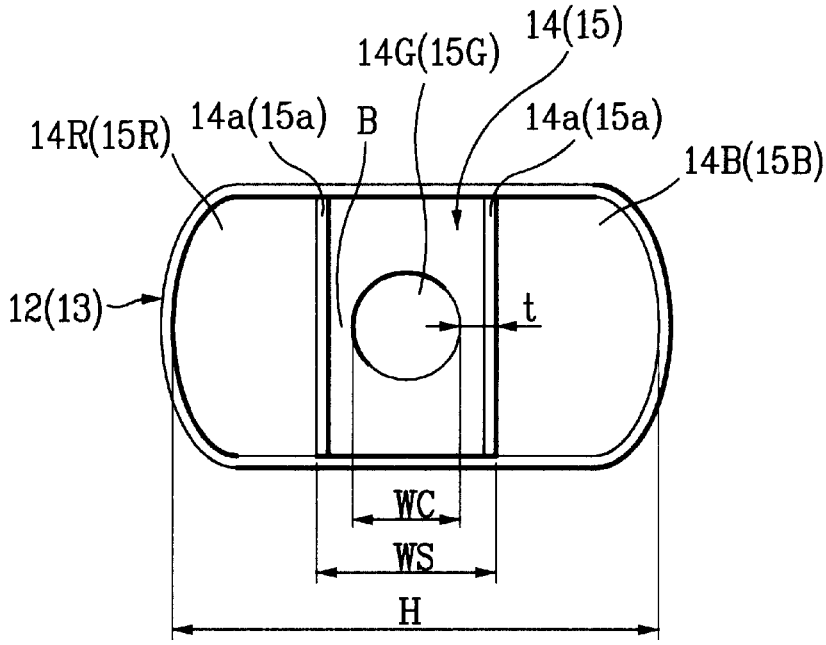
FIG. 10A illustrates a front view of a focusing electrode or an anode seen in II—II or III—III direction in FIG. 3 having the electrostatic field controlling body in FIG. 4A fitted thereto.
Figure 10B:
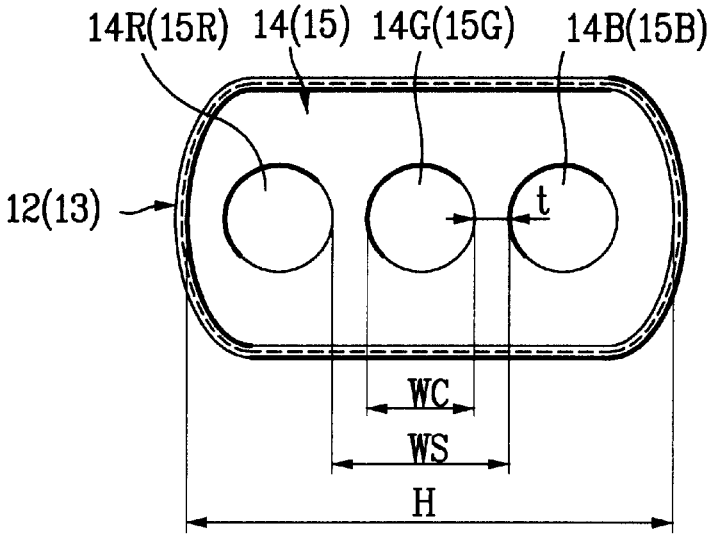
FIG. 10B illustrates a front view of a focusing electrode or an anode seen in II—II or III—III direction in FIG. 3 having the electrostatic field controlling body in FIG. 4D fitted thereto; and, FIG. 11 illustrates a graph of a result of computer simulation showing WS/H vs. P in accordance with a preferred embodiment of the present invention.

In the meantime, the positions of the outer main focusing lenses are required to be shifted outward with respect to the central main focusing electrostatic lens in correspondence to the divergence of the outer electron beams R, and B. Referring to FIG. 10A and 10B, the inventor of the present invention found that a distance P' between centers of the central and outer main focusing electrostatic lenses varies with a ratio WS/H of a sum WS of a horizontal diameter of the central electron beam pass through hole 14G or 15G of the electro static field controlling body 14 or 15 and a minimum width 't' of the bridge 'B' surrounding the central electron beam pass through hole 14G and 15G to a horizontal width 'H' of the rim 12*b* and 13*b*.

Figure 11:
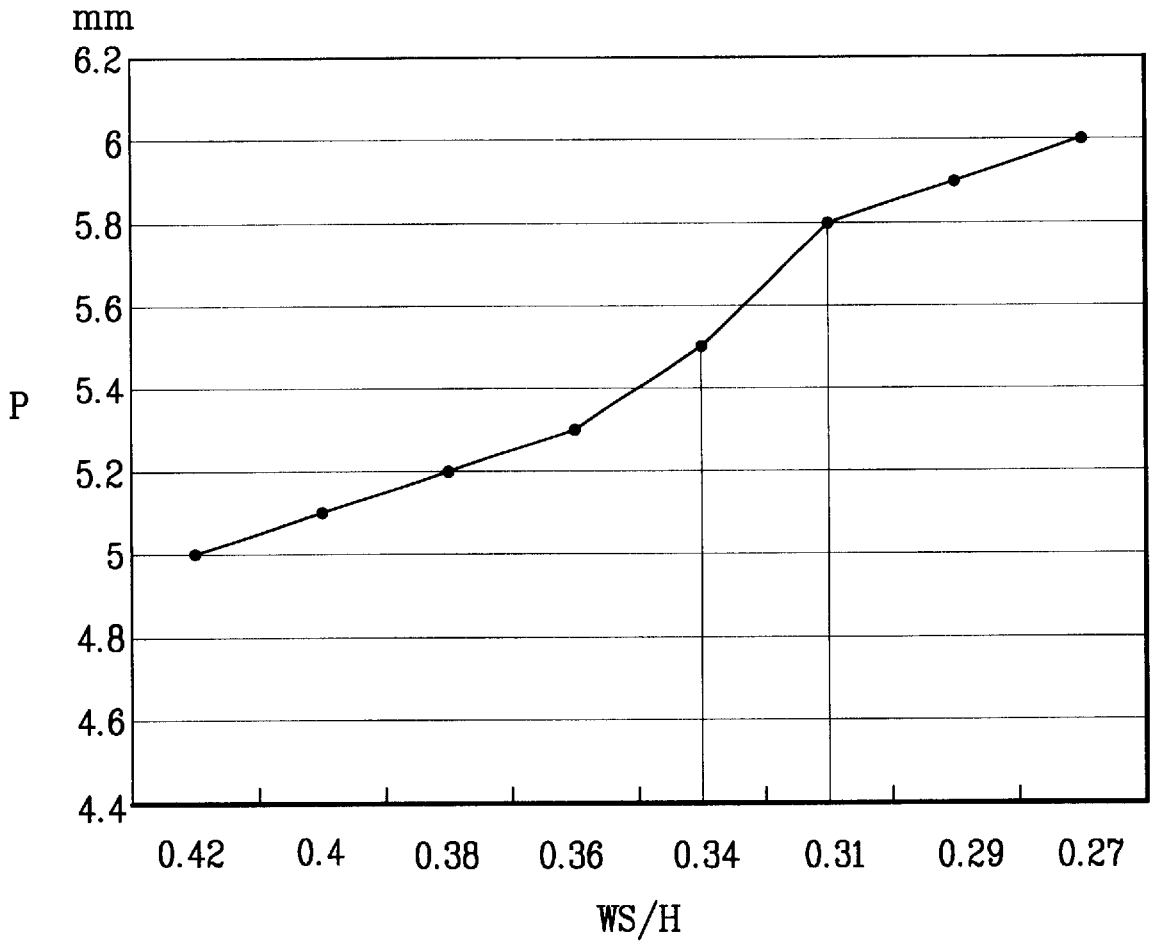

FIG. 11 illustrates a graph of a result of computer simulation showing WS/H vs. P in accordance with a preferred embodiment of the present invention.

Referring to FIG. 11, when WS/H=0.31, a minimum width 't' of the bridge B is 0.5 mm, and when WS/H is in a range of 0.31–0.34, 'P' is in a range of 5.8–5.5 mm, which meets the 'P' range of 5.5–5.7 mm required in FIG. 9, adequately.

The operation of the electron gun in a color CRT of the present invention will be explained, with reference to FIG. 7.

Referring to FIG. 7, as the cathodes 8, the controlling electrode 9, and the accelerating electrode 10 have the same So, the electron beams 3*a* from the cathodes 8 travel on a straight line from the cathodes 8 to the accelerating electrode 10. Then, since $S_1$ of the first pre-focusing electrode 11*a* is smaller than $S_0$, the outer electron beams R and B are diverged outwardly with respect to the central electron beam G. As shown in FIG. 11, since a width 't' of the bridge 'B' of the electron beam pass through hole of the electrostatic field controlling body 14 or 15 is reduced, positions of the outer main focusing electrostatic lenses are shifted outwardly with reference to the central main focusing electrostatic lens in correspondence to the divergence of the outer electron beams R and B. Therefore, the outwardly diverged outer electron beams R and B are focused without being distorted by the outer main focusing electrostatic lens. Thereafter, the electron beams 3*a* pass through the deflection center plane of the deflection yoke 4, when it is proved from an experiment that $S_2'$ is shifted outward by approx. 10% compared to the related art $S_2$. Even if $S_2'$ becomes greater thus, the convergence of the outer electron beams R, and B with respect to the central electron beam G can be enhanced by strengthening the magnetic field of the deflection yoke 4. The solid lines in FIG. 8 illustrate paths of electron beams 3*a* of the electron gun 3 of the present invention, and the dashed lines illustrate paths of electron beams 3*a* of the related art electron gun 3, wherefrom it can be known that the convergence of the present invention at the deflection center plane is greater.

The electron gun in a color CRT of the present invention has the following advantages.

Since the present invention can make $S_2'$ greater, with consequential reduction of 'Q', by adjusting an eccentricity of the first pre-focusing electrode and dimensions of the electrostatic controlling body, the electron gun in a color CRT of the present invention can improve a picture quality without an overall change of the electron gun.

It will be apparent to those skilled in the art that various modifications and variations can be made in the electron gun in a color CRT of the present invention without departing from the spirit or scope of the invention. Thus, it is intended that the present invention cover the modifications and variations of this invention provided they come within the scope of the appended claims and their equivalents.

What is claimed is:

1. An electron gun in a color CRT comprising:

a controlling electrode and an accelerating electrode each having a distance $S_0$ between a central electron beam pass through hole and an outer electron beam pass through hole for passing electron beams emitted from cathodes;

a pre-focusing electrode having a distance $S_1$ between a central electron beam pass through hole and an outer electron beam pass through hole;

a focusing electrode and an anode each having a rim at an opposite part for forming single electron beam pass through hole and an electrostatic field controlling body inside of the rim, for forming a large sized main focusing electrostatic lens by a potential difference; and, diverging means for diverging the outer electron beams incident on the focusing electrode from the pre-focusing electrode outwardly with respect to the central electron beam, wherein a ratio WS/H of a sum WS of a horizontal diameter of the central electron beam pass through hole of the electrostatic field controlling body and a minimum width 't' of the bridge 'B' surrounding horizontal direction outsides of the central electron beam pass through hole to a horizontal width 'H' of the rim is set to be $0.31 \leqq WS/H \leqq 0.34$ for shifting positions of the outer main focusing electrostatic lenses outward in correspondence to the divergence of the outer electron beams with respect to the central main focusing electrostatic lens.

2. An electron gun as claimed in claim 1, wherein the diverging means is one $S_1/S_0$ is set to be in a range of $0.96 \leqq S_1/S_0 \leqq 1$.

3. An electron gun as claimed in claim 1, wherein the diverging means is a color purity magnet fitted to a deflection yoke of the color cathode ray tube.

4. An electron gun as claimed in claim 2, wherein the pre-focusing electrode includes a first and a second pre-focusing electrodes, arranged in the order thereof, and the $S_1$ is applied to the first pre-focusing electrode.

5. An electron gun as claimed in claim 3, wherein the pre-focusing electrode includes a first and a second pre-focusing electrodes, arranged in the order thereof, and the $S_1$ is applied to the first pre-focusing electrode.

* * * * *